US006206212B1

(12) United States Patent
Loew

(10) Patent No.: US 6,206,212 B1
(45) Date of Patent: Mar. 27, 2001

(54) DISPLAY UNIT

(75) Inventor: Jonathon Loew, East Meadow, NY (US)

(73) Assignee: Design Display Group, Inc., Carlstadt, NY (US)

( * ) Notice: Subject to any disclaimer, the term of this patent is extended or adjusted under 35 U.S.C. 154(b) by 0 days.

(21) Appl. No.: 09/225,393

(22) Filed: Jan. 5, 1999

(51) Int. Cl.[7] ..... A47B 47/00; A47F 5/04

(52) U.S. Cl. ..... 211/189; 211/162; 248/224.61; 248/300

(58) Field of Search ..... 211/189, 94.01, 211/107, 87.01, 162; 248/223.41, 224.7, 225.11, 231.91, 218.4, 224.61, 300

(56) References Cited

U.S. PATENT DOCUMENTS

| | | | | |
|---|---|---|---|---|
| 1,656,426 | * | 1/1928 | Cunningham | 248/300 X |
| 2,807,431 | * | 9/1957 | McHale | 248/300 X |
| 3,556,308 | | 1/1971 | McAleenan | 211/134 |
| 3,613,896 | * | 10/1971 | Miller, Jr. | 211/107 |
| 3,884,442 | * | 5/1975 | Breeden et al. | 211/107 |
| 4,106,617 | * | 8/1978 | Boone | 248/224.7 X |
| 4,172,334 | | 10/1979 | Nielsen | 40/607 |
| 4,300,299 | | 11/1981 | Batky et al. | 40/607 |
| 4,566,211 | | 1/1986 | Gustafson et al. | 40/605 |
| 4,887,783 | * | 12/1989 | Franklin | 211/87.01 X |
| 5,255,803 | | 10/1993 | Pavone et al. | 211/189 |
| 5,419,134 | * | 5/1995 | Gibson | 248/223.41 X |
| 5,547,088 | | 8/1996 | Belokin et al. | 211/87 |
| 5,560,131 | | 10/1996 | Gibson | 40/607 |
| 5,566,844 | | 10/1996 | Bernardin | 211/189 |
| 5,582,376 | * | 12/1996 | Thompson | 211/94.01 |
| 5,611,439 | * | 3/1997 | Scott | 211/64 |
| 5,626,926 | | 5/1997 | Roberts | 428/14 |
| 5,702,011 | | 12/1997 | Carroll | 211/135 |
| 5,855,281 | * | 1/1999 | Rabas | 211/189 X |

* cited by examiner

*Primary Examiner*—Daniel P. Stodola
*Assistant Examiner*—Erica B Harris
(74) *Attorney, Agent, or Firm*—Steinberg & Raskin, P.C.

(57) ABSTRACT

A display unit including a plastic panel and first and second generally L-shaped plastic frame members attached to opposed edges of the panel to form a generally U-shaped assembly. The panel includes structure for enabling the display of merchandise. The display unit includes mounting components for mounting the assembly to a substrate, such as a column in a store, round, rectangular or square, or ends of a shelving unit. The U-shaped assembly is preferably made entirely of a plastic which is rigid yet somewhat resilient. A method for optimizing an exposed column in a store for sales purposes is also disclosed in which a generally U-shaped plastic assembly having a panel is mounted to the column and the panel is provided with structure for enabling the display of merchandise.

3 Claims, 4 Drawing Sheets

31
42
4
28
18
54
58
20
12
56
58
54
22
24
46
44
40
38
74
48
36
34
40
44
46
42
24
22
20
26
18
12
54
58
56
58
54

14
30
30
20
22
18

DISPLAY UNIT

FIELD OF THE INVENTION

The present invention relates generally to a display unit for enabling the display of merchandise, and more particularly to a display unit for attachment to a column or an end of a shelving unit. Such a display unit is often referred to in the art as a "sidekick unit".

BACKGROUND OF THE INVENTION

As a result of the construction and layout of some stores, there are often columns in the aisles. These columns are solid and may be either round, rectangular or square. In view of the presence of the columns in the aisles, shoppers often unintentionally bump into them or unintentionally bump their shopping carts or baby strollers into them. This has the potential to cause injury to the shoppers or damage to the shopping carts or strollers.

Furthermore, although the columns in the aisles are viewed by the people walking in the aisle, there is no satisfactory display for attachment to such columns and thus prime display sites are not being utilized to their fullest potential.

In addition, in stores having display units having rows of running shelves, a sidekick unit is often placed at the end of each row. A prior art sidekick unit is generally U-shaped having a rear wall and opposed sides and items for sale are placed on the rear wall, and possibly sides as well, of the sidekick unit. One problem with conventional sidekick units is that they are made of metal and therefore, the sides are easily damaged when a shopping cart is pushed into the sides. This damage is often permanent and cannot be corrected without extensive work. Therefore, once damaged, metal sidekick units are usually replaced.

OBJECTS AND SUMMARY OF THE INVENTION

It is an object of the present invention to provide a new and improved display unit.

It is another object of the present invention to provide a new and improved display unit which is attachable to columns which might be located in aisles of stores.

It is a further object of the present invention to provide a new and improved sidekick display unit for placement at the ends of running shelving units.

It is another object of the present invention to provide a new and improved display unit which is not as easily damaged as prior art display units thereby avoiding the need to continually replace the display unit.

In view of achieving these objects and others, the display unit in accordance with the invention comprises two substantially identical, generally L-shaped plastic frame members arranged such that a slot of one frame member is in alignment with a slot of the other frame member, and a plastic panel secured in the slots of the frame members to thereby form an assembly of the frame members and panel which is attachable to a structure or substrate in the store, such as a column or running shelving unit. The panel provides a merchandise display substrate, e.g., it includes horizontal grooves or slots into which display hooks may be mounted so that merchandise may be placed on the hooks. The panel has opposed edges, each being situated in the slot of a respective frame member and secured in connection therewith.

An important aspect of the invention is that the frame members are made of plastic so as to provide the frame members with some rigidity yet maintain some resiliency in the event that a person bumps into the frame members or bumps their shopping cart or stroller into the frame members. As such, the frame members would yield to the force of the person or shopping cart upon impact but once the person or shopping cart is moved out of contact with the frame member, the frame member would return to its original form (unless the force of the person or shopping cart were sufficient to break the frame member). Damage to the frame members is thus minimized. By contrast, in prior art metal display units, impact of a shopping cart into the frame usually causes the frame to bend and the metal does not return to its original form. The actual types of plastic would be apparent to one of ordinary skill in the art of display and/or readily ascertainable without undue experimentation. Other materials which exhibit the same properties, i.e., overall rigidity coupled with resiliency, could also be used in accordance with the invention without deviating from the scope and spirit thereof.

The display unit includes mounting means for attaching the assembly to the structure in the store, which may be a fixed column in an aisle of the store, a running shelving unit or any other fixed or movable support substrate in the store. In one particular non-limiting embodiment, the mounting means comprises two metal brackets attached to the rear surfaces of the frame members and metal hook members attachable to the substrate in the store. The hook members each define an upwardly facing slot into which a respective bracket is positioned and each hook member is positioned at the same distance from another as the distance between the brackets on the assembly. The brackets are preferably arranged one proximate a top of the assembly and the other proximate a bottom of the assembly. The assembly is thus easily positionable on the substrate by lifting the assembly so that the brackets are situated over the slots in the hook members and then lowering the assembly until the brackets are engaged in the slots in the hook members. In a similar manner, the display unit is easily removable from the substrate by lifting the assembly upward so that the brackets are removed from engagement with the hook members and then away from the substrate. To secure the brackets to the rear surfaces of the frame members, the frame members each include a slot formed in a projection on the rear surface, the slots being in alignment with each other, and each bracket has an edge situated in the slot on the rear surface of each frame member. Attachment means, e.g., screws, nails, adhesive, are provided for fixedly attaching each bracket to the frame members.

To increase awareness of the merchandise being displayed on the display unit to shoppers which do not have a line of sight to the merchandise or cannot view the merchandise, one or more of the frame members preferably includes a pair of opposed projections extending from an outer surface. Each projection defines a slot adapted to receive an edge of display, sales or promotional literature, i.e., the literature is slid into the slots from an end of the assembly. This literature would ideally be related to the merchandise being displayed.

A display unit in accordance with the invention may, in the alternative, comprise a generally U-shaped assembly made entirely of plastic and including a flat panel having means for enabling the display of merchandise, and mounting means for attaching said assembly to a substrate. The mounting means may comprise at least one bracket attached to the assembly and having a flat portion, and at least one hook member attachable to the substrate and defining a slot. Each bracket and respective hook member(s) is arranged such that the bracket is positionable in the slot of the respective hook member(s). In one form, each bracket includes a flat central portion for enabling attachment of the assembly to a flat substrate. In another form, each bracket includes a curved portion for enabling attachment of the assembly to a curved substrate. The assembly preferably includes first and second generally L-shaped frame members, each defining a slot, whereby the frame members are arranged such that the slots of the frame members are in alignment with one another. The panel has edges situated in the slots of the frame members.

In a method for optimizing an exposed column in a store for sales purposes, a generally U-shaped plastic assembly having a rear panel is mounted to the column and the panel is provided with means for displaying merchandise. The assembly includes first and second substantially identical, generally L-shaped plastic frame members, each defining a slot, and the assembly is preferably constructed by arranging the frame members such that the slots of the frame members are in alignment with each other and the edges of the panel are situated in a respective one of the slots of the frame members. The assembly may be mounted to the column by attaching one or more brackets to the assembly, attaching one or more hook members to the column (at least one hook member for each bracket), and positioning the bracket(s) in an upward facing slot of the respective hook member(s). The brackets and hook members are preferably made of metal.

BRIEF DESCRIPTION OF THE DRAWINGS

A more complete appreciation of the present invention and many of the attendant advantages thereof will be readily understood by reference to the following detailed description when considered in connection with the accompanying drawings in which.

DETAILED DESCRIPTION OF THE PREFERRED EMBODIMENTS

Figure 1:
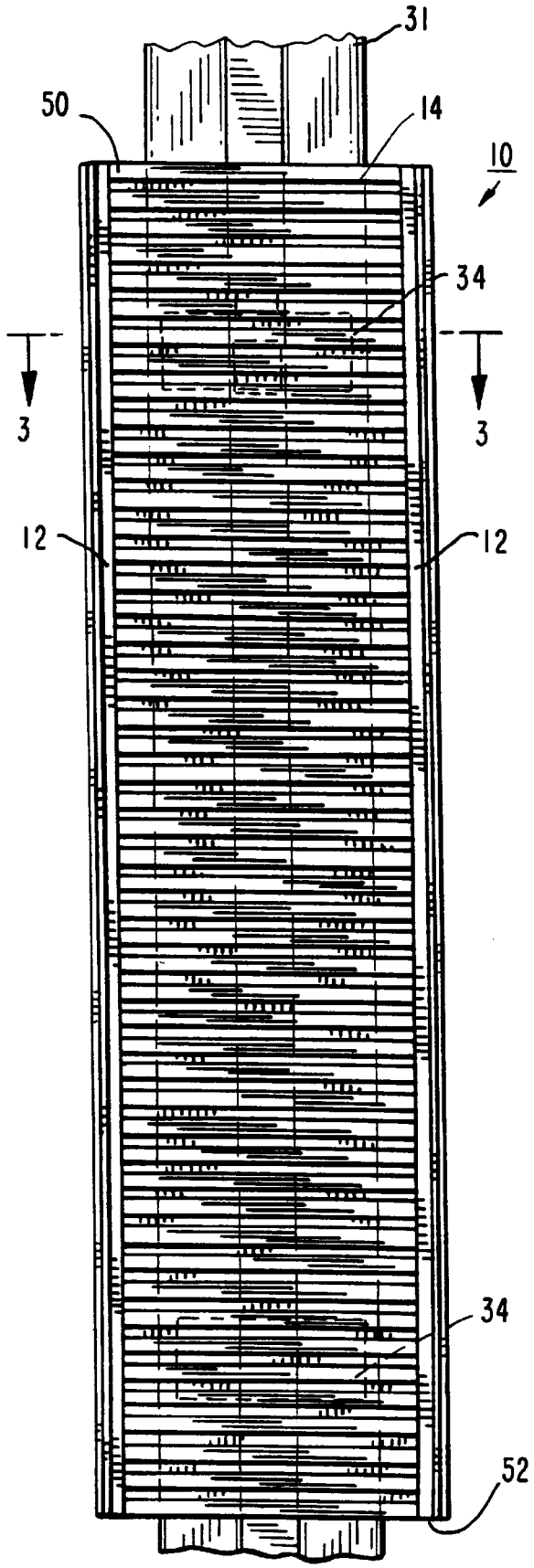
FIG. 1 is a front view of a display unit in accordance with the invention attached to a square column.

Referring to the accompanying drawings wherein like reference characters designate identical or corresponding parts throughout the several views, a display unit in accordance with the present invention is designated generally 10 and includes first and second plastic frame members 12 and a generally planar panel 14 coupled to the frame members 12 to thereby define an assembly 16. Frame members 12 are elongate and identical to one another and have a generally L-shaped cross-sectional shape. Each frame member 12 comprises a first generally planar wall 18, a second generally planar wall 20 connected to and arranged perpendicular to the first wall 18 and a third generally planar wall 22 connected to and arranged perpendicular to the second wall 20. The third wall 22 is arranged parallel to and at a distance from the first wall 18 and extends from the second wall 20 a distance smaller than the extension of the first wall 18 from the second wall 20 such that a slot 24 is defined between the first and third walls 18,22. In its assembled state as shown, the slots 24 of the frame members 12 are situated in alignment with one another to retain edges of the planar panel 14. To enhance retention of the panel 14 in the slots 24, adhesive may be applied between adjoining surfaces of the frame members 12 and panel 14. Frame members 12 also includes a pair of opposed, parallel projections 54, each extending from an outer surface 56 of the second wall 20 and defining a slot 58. Slots 58 extend along the length of the frame members 12 and are adapted to receive edges of display, sales or promotional literature, which would ideally be related to the merchandise being displayed by the unit 10.

Figure 4:
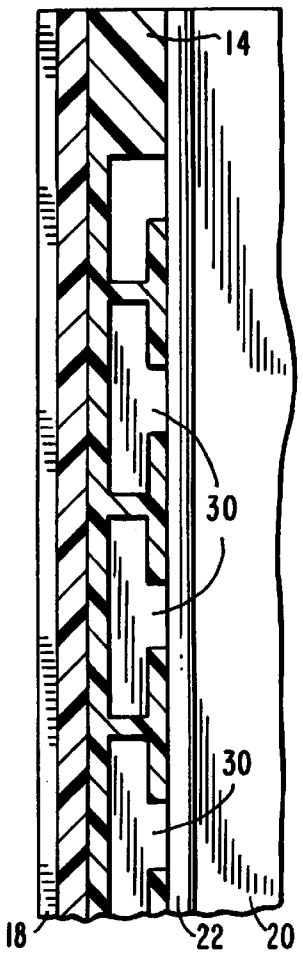
FIG. 4 is a partial sectional view of the display unit shown in FIG. 1 taken along the line 4—4 in FIG. 3.

Panel 14 is made of plastic and has first and second edges 26,28. In its assembled state as shown, edges 26,28 are situated in the slot 24 of a respective frame member 12. Panel 14 includes means for displaying merchandise, e.g., horizontal T-shaped grooves or slots 30 extending between edges of the panel 14 and into which display hooks (not shown) may be placed (see FIG. 4). Panel 14 may be comprised of one or more pieces of plastic commonly referred to as slot board. The components used with slot board for displaying merchandise, i.e., the construction of mating hook members, is known to those skilled in the art. Other planar panels may also be used in the invention so long as the panels provide some structure to enable merchandise for sale to be displayed. Also, although plastic panels are preferred, the panels may be made of materials other than plastic, such as metal.

Figure 2:
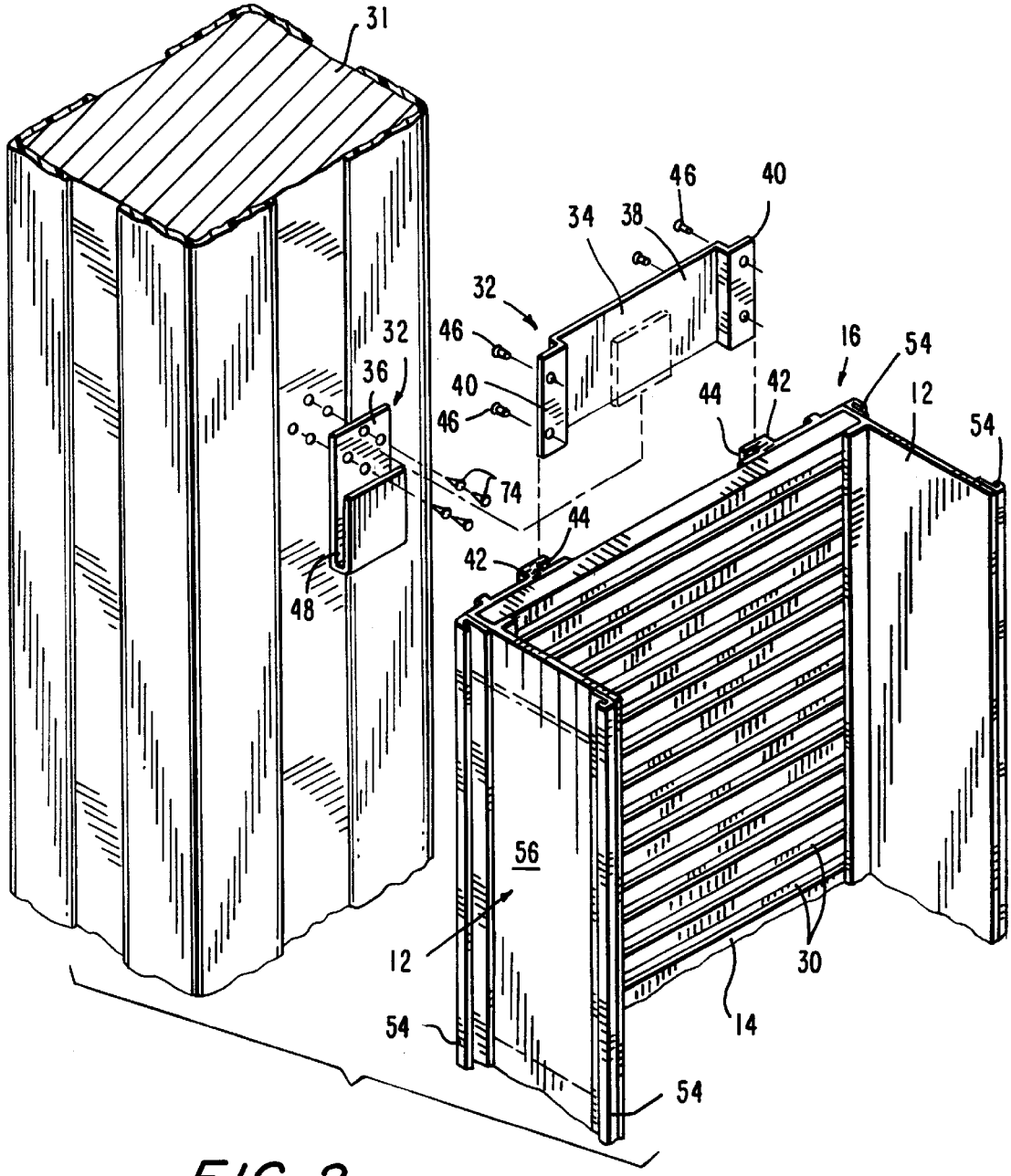
FIG. 2 is a partial exploded view of the display unit shown in FIG. 1.
Figure 3:
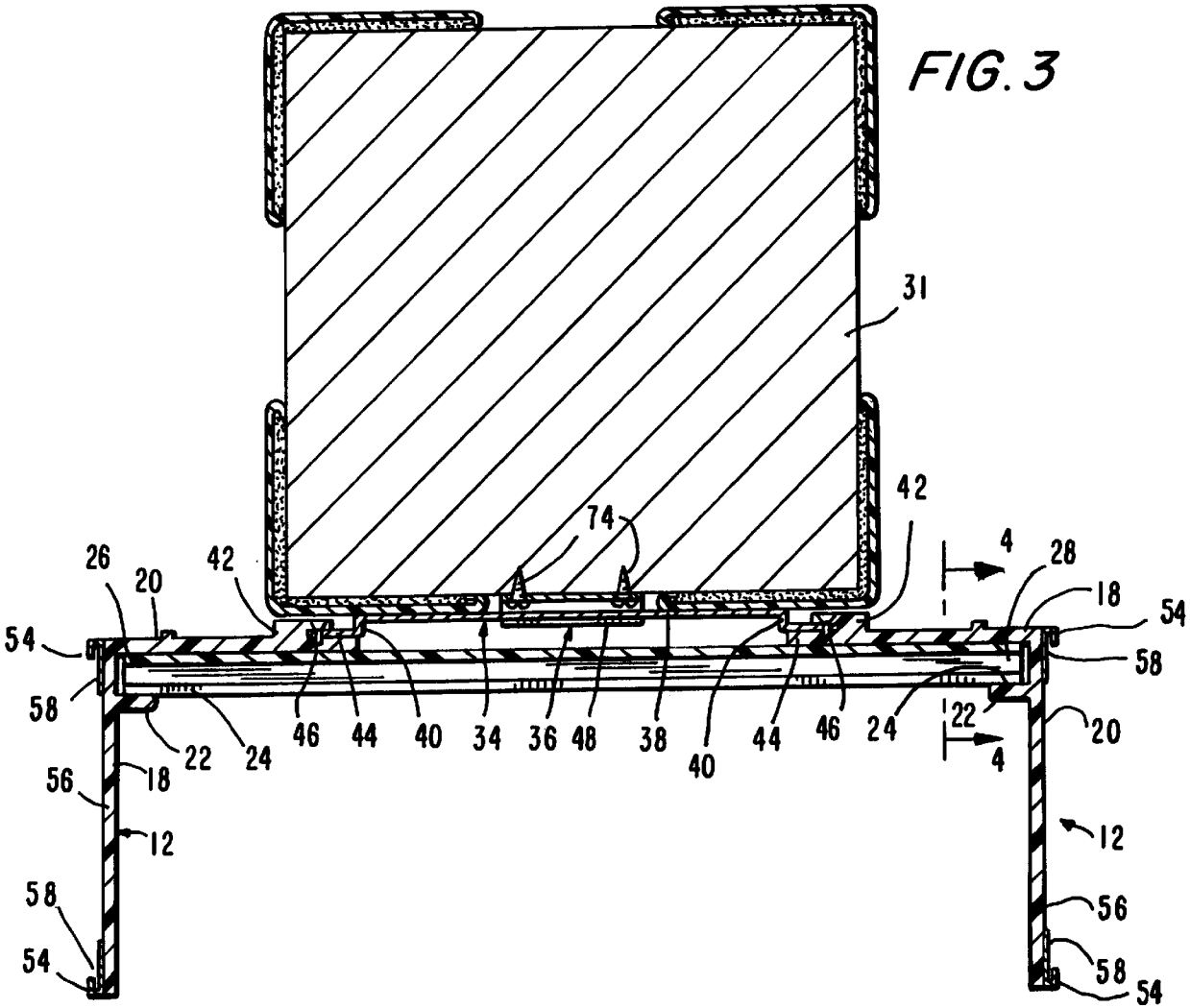
FIG. 3 is a sectional view of the display unit shown in FIG. 1 taken along the line 3—3 in FIG. 1.

The assembly 16 is attached to a flat substrate in the store, e.g., a side of a square column 31 as shown in FIGS. 1–3, by appropriate mounting means 32. In the illustrated embodiment of FIGS. 1–4, the mounting means include brackets 34 attached to the assembly 16 and hook members 36 attachable to the substrate 31 (FIG. 2). Brackets 34 are preferably metal and include a planar central portion 38 and a flange 40 on each side of the central portion 38. Frame members 12 include a projection 42 on a rear surface defining a slot 44. The flanges 40 of the brackets 34 are positioned in the slots 44 of the frame members 12 and secured therein by appropriate attachment means, e.g., screws 46. Nails and adhesives are also possible attachment means. Hook members 36 are generally J-shaped and define an upward facing slot 48. Also, hook members 36 are made of metal and are provided with holes to enable attachment to the substrate 30 by means of screws or nails 74. The brackets 34 are positionable in the slot 48 of a respective aligning one of the hook member 36 such that the assembly is thus securely attached to the substrate 31.

As shown in FIG. 1, the display unit 10 includes two brackets 34, one arranged proximate a top edge 50 of the assembly 16 and a second arranged proximate a bottom edge 52 of the assembly 16. If necessary or desired, two or more hook members 36 can be positioned alongside one another to receive a single bracket.

Figure 5:
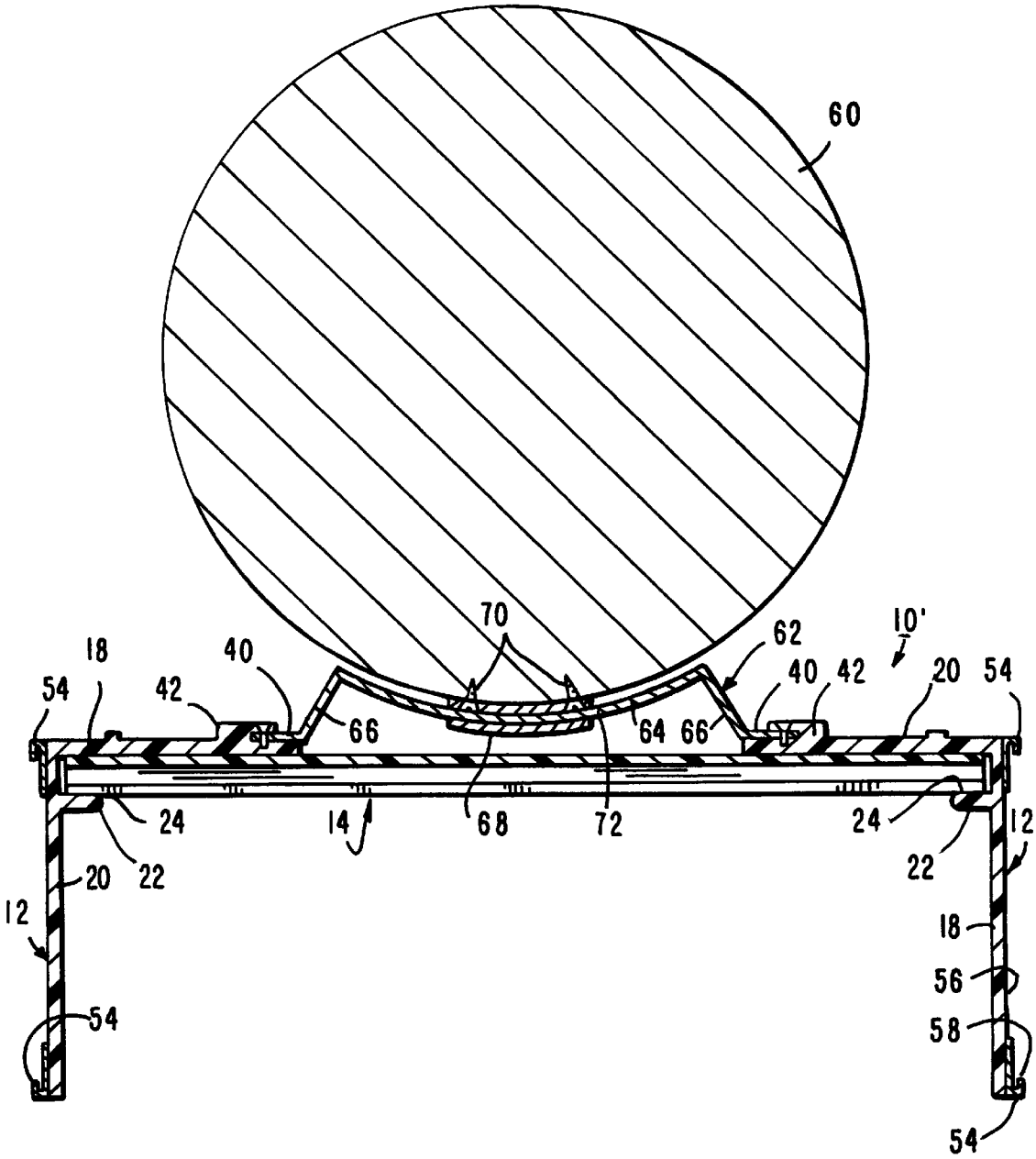
FIG. 5 is a sectional view of a second embodiment of a display unit in accordance with the invention for attachment to a round column.

FIG. 5 shows an embodiment of the display unit 10 which is attachable to a round column 60. Thus, the mounting means of this display unit (designated 10') includes brackets 62 (only one of which is shown) having a curved central portion 64 and angled portion 66 extending between the curved portion 64 and the flanges 40. The mounting means also include curved hook members 68 (only one of which is shown) attachable to the column 60 by means of screws or nails 70. Hook members 68 define an upward facing slot 72 into which brackets 62 are positionable.

To assemble the display unit 10;10' a pair of frame members 12 are pre-formed having the desired length of the display unit 10;10' (since the length of the display unit 10;10' is variable and depends, e.g., on the length of the frame members 12). A panel 14, having a width which is to be the approximate width of the display unit 10;10' formed of one or more sections of slot board is provided and each edge of the panel 14 is slid into a slot 24 of a respective frame member 12 to form an assembly 16. Adhesive may be applied before, during or after insertion of the edges of the panel 14 into the slots 24. Edges of the brackets 34;62 are slid into the slots 44 formed on the rear surfaces of the frame members 12 and fixed thereto, e.g., by screwing screws 46 through the projections 42 defining the slots 44.

To attach the display unit 10 to the substrate 31;60 in the store, hook members 36;68 are fixed to the substrate 31;60 in the store, e.g., a column or running shelving unit, to which the display unit 10;10' will be mounted. The vertical distance between the hook members 36;68 is the same as the distance between the brackets 34;62. The assembly 16 is then lifted up so that the brackets 34;62 are over the hook members 36;68 and then lowered to cause the brackets 34;62 to enter into the slots 48;72 in the hook members 36;68. The manual hold of the display unit 10;10' is then released. Display hooks are then inserted into the grooves 30 on the front face of the panel 14 and merchandise is attached to the display hooks.

For a rectangular or square column, a display unit in accordance with the invention may be attached to each side of the column. In the alternative, a display unit could be attached only to two opposed sides of the column. For a round column, a display unit could be attached on each side thereof to cover the exposed surfaces of the column. The size of the display units could be selected to cover the sides of the columns without exposed surfaces. The display units could also be constructed with variable widths by selected panels 14 having different widths. The length of the display units 10 could also be varied by selecting frame members and panels having different lengths.

As mentioned above, the display unit in accordance with the invention can also be placed at each end of a running shelving unit, i.e., a shelving unit having rows of shelves. If a substrate to which the hook members 36 is present at the ends of the shelving unit, then the hook members 36 are attached to this substrate. Otherwise, it is possible to attach a substrate to the ends of the shelving unit and then attached the hook members 36 thereto.

The examples provided above are not meant to be exclusive. Many other variations of the present invention would be obvious to those skilled in the art, and are contemplated to be within the scope of the appended claims.

I claim:

1. A display unit, comprising first and second plastic frame members, each of said frame members defining a first slot therein, said frame members being arranged such that said first slot of said first frame member is in alignment with said first slot of said second frame member, a flat plastic panel having first and second edges and being coupled to said first and second frame members whereby an assembly of said first and second frame members and said panel is formed in which said first edge of said panel is situated in said first slot of said first frame member and said second edge of said panel is situated in said first slot of said second frame member, said panel including means for enabling the display of merchandise, mounting means for attaching said assembly to a substrate, comprising at least one bracket attached to said assembly and at least one hook member attachable to the substrate and defining a slot, each of said at least one bracket and a respective one of said at least one hook member being arranged such that said bracket is positionable in said slot of said at least one hook member, and wherein said first and second frame members each include a second slot on a rear surface thereof, said frame members being arranged such that said second slot of said first frame member is in alignment with said second slot of said second frame member, said at least one bracket having a first edge situated in said second slot of said first frame member and a second edge situated in said second slot of said second frame member.

2. The display unit of claim 1, further comprising attachment means for fixedly attaching said at least one bracket to said first and second frame members.

3. A method for optimizing an exposed column in a store for sales purposes, comprising the steps of:

constructing a generally U-shaped plastic assembly having a rear panel, first and second generally L-shaped plastic frame members, each of the frame members defining a first slot therein by arranging the frame members such that the first slot of the first frame member is in alignment with the first slot of the second frame member and a first edge of the panel is situated in the first slot of the first frame member and a second edge of the panel is situated in the first slot of the second frame member, attaching at least one bracket to the assembly, attaching at least one hook member to the column, and positioning the at least one bracket in a slot of a respective one of the at least one hook member, providing the panel with means for enabling the display of merchandise, and wherein the first and second frame members each include a second slot on a rear face thereof and are arranged such that the slot of the first frame member is in alignment with the slot of the second frame member, further comprising the step of:

attaching the at least one bracket to the first and second frame members by arranging a first edge of the at least one bracket in the second slot of the first frame member and a second edge of the at least one bracket in the second slot of the second frame member.

* * * * *

UNITED STATES PATENT AND TRADEMARK OFFICE

CERTIFICATE OF CORRECTION

PATENT NO. : 6,206,212 B1
DATED : March 27, 2001
INVENTOR(S) : Loew, Jonathan

It is certified that error appears in the above-identified patent and that said Letters Patent is hereby corrected as shown below:

Title page,
Item [73], the state in which the assignee is located is New Jersey.

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*